US012601342B2

(12) United States Patent
Begolo et al.

(10) Patent No.: US 12,601,342 B2
(45) Date of Patent: Apr. 14, 2026

(54) FLUID-ACTUATED MICROFLUIDIC MEMBRANE PUMP WITH DIFFERENTLY-SIZED INLET AND OUTLET PORTS

(71) Applicant: ALine, Inc, Signal Hill, CA (US)

(72) Inventors: Stefano Begolo, Inglewood, CA (US); Leanna M. Levine, San Pedro, CA (US)

(73) Assignee: Aline, Inc., Signal Hill, CA (US)

( * ) Notice: Subject to any disclaimer, the term of this patent is extended or adjusted under 35 U.S.C. 154(b) by 50 days.

(21) Appl. No.: 18/487,783

(22) Filed: Oct. 16, 2023

(65) Prior Publication Data

US 2024/0125315 A1 Apr. 18, 2024

Related U.S. Application Data

(60) Provisional application No. 63/416,009, filed on Oct. 14, 2022.

(51) Int. Cl.

| | |
|---|---|
| ***F04B 43/06*** | (2006.01) |
| ***F04B 19/00*** | (2006.01) |
| ***F04B 53/16*** | (2006.01) |

(52) U.S. Cl.

CPC ..... *F04B 43/06* (2013.01); *F04B 53/16* (2013.01); *F04B 19/006* (2013.01)

(58) Field of Classification Search

CPC .... F04B 19/006; F04B 43/0027; F04B 43/14; F04B 43/053; F04B 43/06; F04B 43/043; F04B 53/1077

See application file for complete search history.

(56) References Cited

U.S. PATENT DOCUMENTS 3,314,371 A * 4/1967 Hopkinton ..... F04B 43/021 417/474
5,096,388 A * 3/1992 Weinberg ..... F04B 43/043 417/474

(Continued)

FOREIGN PATENT DOCUMENTS

DE 4223019 C1 * 11/1993 ..... F04B 19/006

OTHER PUBLICATIONS

Chiou [Deformation Analysis of a Pneumatically-Activated Polydimethlsiloxane (PDMS) Membrane and Potential Micro-Pump Applications, 2015]. (Year: 2015).*

*Primary Examiner* — Nathan C Zollinger
(74) *Attorney, Agent, or Firm* — Hiibner Law; Kristin C. Hiibner

(57) ABSTRACT

A microfluidic pump with a movable drive membrane (diaphragm), a pumping chamber, at least two fluidic ports on one side of the diaphragm, and at least one control port on an opposing side of the diaphragm is provided. A flexible drive membrane intersects the pumping chamber such that a pressure chamber is created on the side of the drive membrane which is open to the control port, and a fluid flow chamber is created on the side of the drive membrane which is open to the fluidic ports. The drive membrane acts as a valve sealing and unsealing the fluidic ports and fluid flow through the flow chamber. The microfluidic pump has an asymmetric design which facilitates the sealing and unsealing of the fluidic ports by the pressure differential in the pressure chamber.

13 Claims, 10 Drawing Sheets

(56) References Cited

U.S. PATENT DOCUMENTS

| | | | | |
|---|---|---|---|---|
| 6,203,291 | B1 * | 3/2001 | Stemme | F04B 53/1077 417/322 |
| 7,284,966 | B2 * | 10/2007 | Xu | F04B 53/106 417/413.2 |
| 8,210,830 | B2 * | 7/2012 | Miyazaki | F04B 53/1077 417/413.2 |
| 9,638,182 | B2 * | 5/2017 | Pinkerton | F04B 43/043 |
| 2004/0146409 | A1 * | 7/2004 | Lee | F04B 19/24 417/207 |
| 2024/0287977 | A1 * | 8/2024 | Yoshida | F04B 43/02 |

* cited by examiner

300

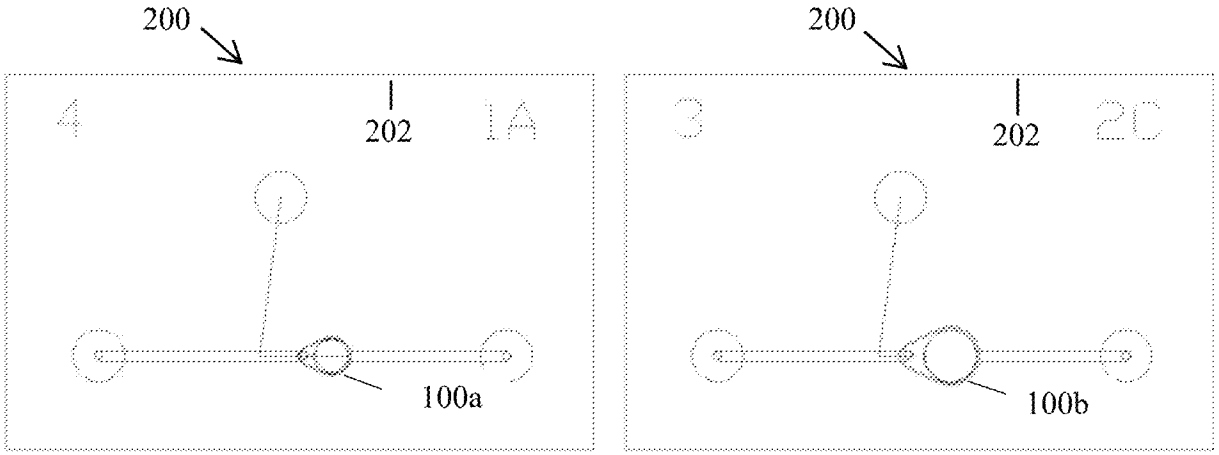
Figure 5A
Figure 5B
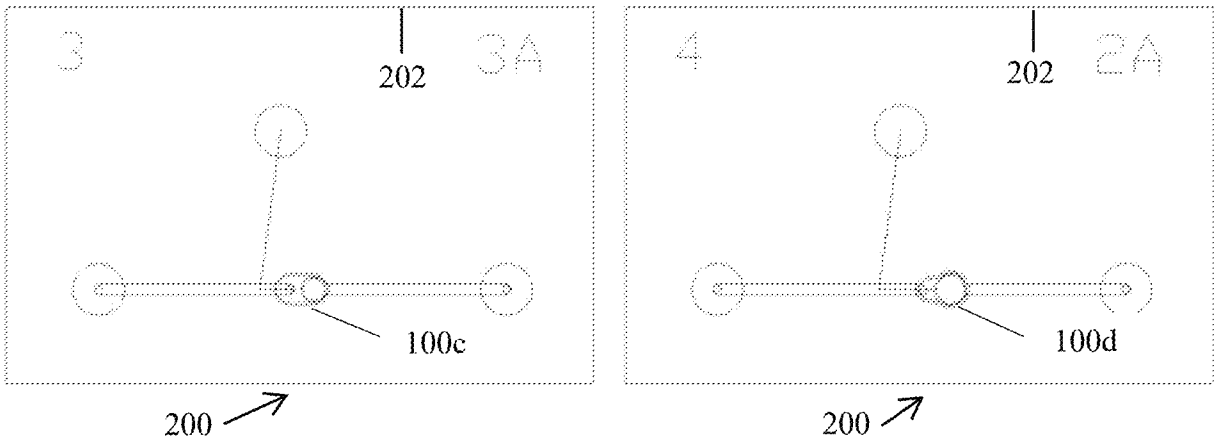
Figure 5C
Figure 5D

FLUID-ACTUATED MICROFLUIDIC MEMBRANE PUMP WITH DIFFERENTLY-SIZED INLET AND OUTLET PORTS

CROSS-REFERENCE TO RELATED APPLICATIONS

This application claims the benefit of U.S. Provisional Application No. 63/416,009 filed on Oct. 14, 2022, the complete disclosure of which is incorporated herein by reference for all purposes.

BACKGROUND

A diaphragm pumps, also known as a membrane pump, is a positive displacement pump that uses the reciprocating action of a diaphragm to pump fluid. Known diaphragm pumps used on microfluidic cassettes are generally comprised of three moving parts: a drive diaphragm, an inlet non-return valve, and an outlet non-return valve. Known non-return valves include check valves, butterfly valves, flap valves, or other forms of shut-off (non-return) valves. Non-return valves in diaphragm pumps are most commonly check valves, and a variety of configurations of check valves have been used in the art. The non-return valves are generally arranged before and after the inlet and outlet orifices of the pumping chamber, and the drive diaphragm is generally arranged over a pumping chamber. The shape of the pumping chamber is usually symmetric in the x-y directions and the pump function is not dependent on the shape of the pumping chamber.

There are various types of diaphragm pumps which operate by increasing the volume of a chamber by moving the diaphragm up (decreasing pressure), and drawing fluid into the chamber. When the chamber pressure later increases from decreased volume (the diaphragm moving down), the fluid previously drawn in is forced out. Finally, the diaphragm moving up once again draws fluid into the chamber, completing the cycle.

In these systems, pumping can be affected by periodically cycling excursions of the drive diaphragm above and/or below its unactuated position, causing the volume of the pumping chamber to periodically increase and decrease. Also, in these systems, the motion of the drive diaphragm is not intended to seal the inlet or outlet orifices of the pumping chamber. These seals are affected by the non-return valves.

Known microfluidic pumps and systems have one or more disadvantages including multiple moving parts, complicated fabrication of the valve and microfluidic device, valve malfunction, and decreased pump efficiency.

SUMMARY

According to the disclosure, a microfluidic pump is provided. The pump has a movable drive membrane (diaphragm), a pumping chamber, at least two fluidic ports on one side of the diaphragm (e.g., and inlet and outlet port), and at least one control port on an opposing side of the diaphragm. A flexible drive membrane intersects the pumping chamber such that a pressure chamber is created on the side of the drive membrane which is open to the control port, and a fluid flow chamber is created on the side of the drive membrane which is open to the fluidic ports. The drive membrane acts as a valve sealing and unsealing the fluidic ports and fluid flow through the flow chamber.

The microfluidic pump has an asymmetric design which facilitates the sealing and unsealing of the fluidic ports by the pressure differential in the pressure chamber. Accordingly, of at least one of the following components is non-symmetrical in at least one direction: pumping chamber dimensions, fluidic ports position/dimensions, control port (s) position.

As described herein, when positive pressure is introduced through the control port, the drive membrane contacts the "floor" of the pumping chamber at the location of the inlet port, thereby sealing the inlet port. During relaxation of the drive membrane back to its neutral position, both ports unseal and there is fluid flow in the flow chamber through both ports. When the drive membrane of the is subjected to a single positive excursion and held at its maximum positive excursion, the microfluidic pump mimics the function of a two-way valve in its "closed" state. When the drive membrane of the diaphragm pump is permitted to remain in its neutral position, the diaphragm pump mimics the function of a two-way valve in its "open" state.

Advantageously, the microfluidic pump described herein, has a single moving part, the diaphragm. The diaphragm also operates as a valve to close the pumping chamber to fluid flow. The feature of the diaphragm being the single moving part and also operating as a valve to seal the pumping chamber simplifies the fabrication of microfluidic cassettes that require onboard diaphragm pumps. The fabrication of microfluidic cassettes is further simplified because two distinct fluid control functions can be affected by construction of a single type of structure on the microfluidic cassettes. In addition, mechanical parts are subject to break down and fewer moving parts decreases the likelihood of valve malfunction.

BRIEF DESCRIPTION OF THE DRAWINGS

These and other features, aspects and advantages of the present invention will become better understood from the following description, appended claims, and accompanying figures where:

FIGS. 5*a*-5*d* are schematic diagrams showing various configurations of the microfluidic pump incorporated into a microfluidic device;

DETAILED DESCRIPTION OF PREFERRED EMBODIMENTS

According to the disclosure, a microfluidic pump is provided. The microfluidic pump has a pumping chamber which is intersected by a flexible drive membrane to create two chambers, a pressure chamber, and a fluid flow chamber within the pumping chamber. A control port is positioned on the side of the pump where the pressure chamber is located, and inlet and outlet ports are positioned on the side of the pump where the fluid flow chamber is located. A flexible drive membrane intersects the pumping chamber such that a pressure chamber is created on the side of the drive membrane which is open to the control port. A fluid flow chamber is created on the side of the drive membrane which is open to the fluidic ports. The drive membrane acts as a valve sealing and unsealing the fluidic ports and fluid flow through the flow chamber.

The microfluidic pump and systems described herein have one or more advantages over known pumps and systems, including fewer moving parts, less complication in fabrication of the valve and microfluidic device, fewer moving parts which lessens the probability of valve malfunction, and increased pump efficiency.

Figure 1A:
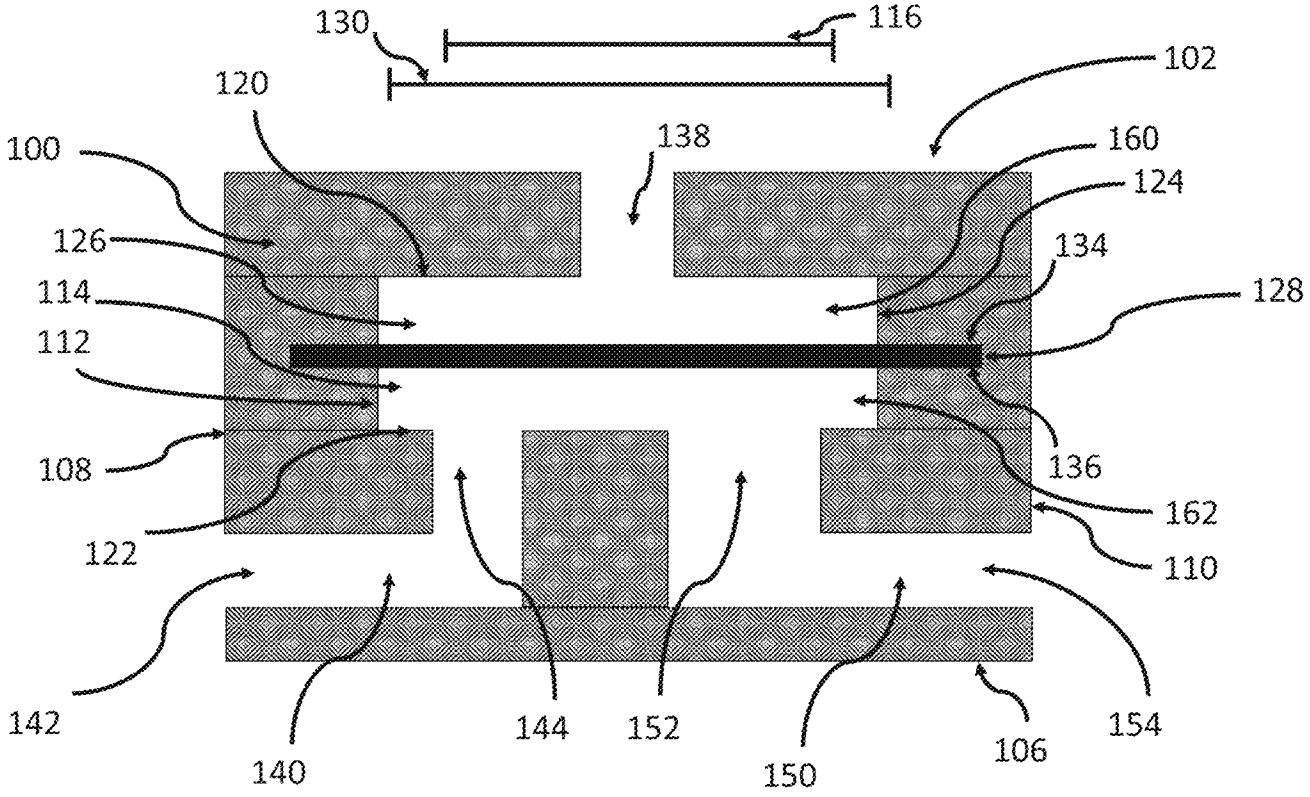
FIG. 1A is a schematic diagram of a side view of the microfluidic pump, according to one embodiment.
Figure 1B:
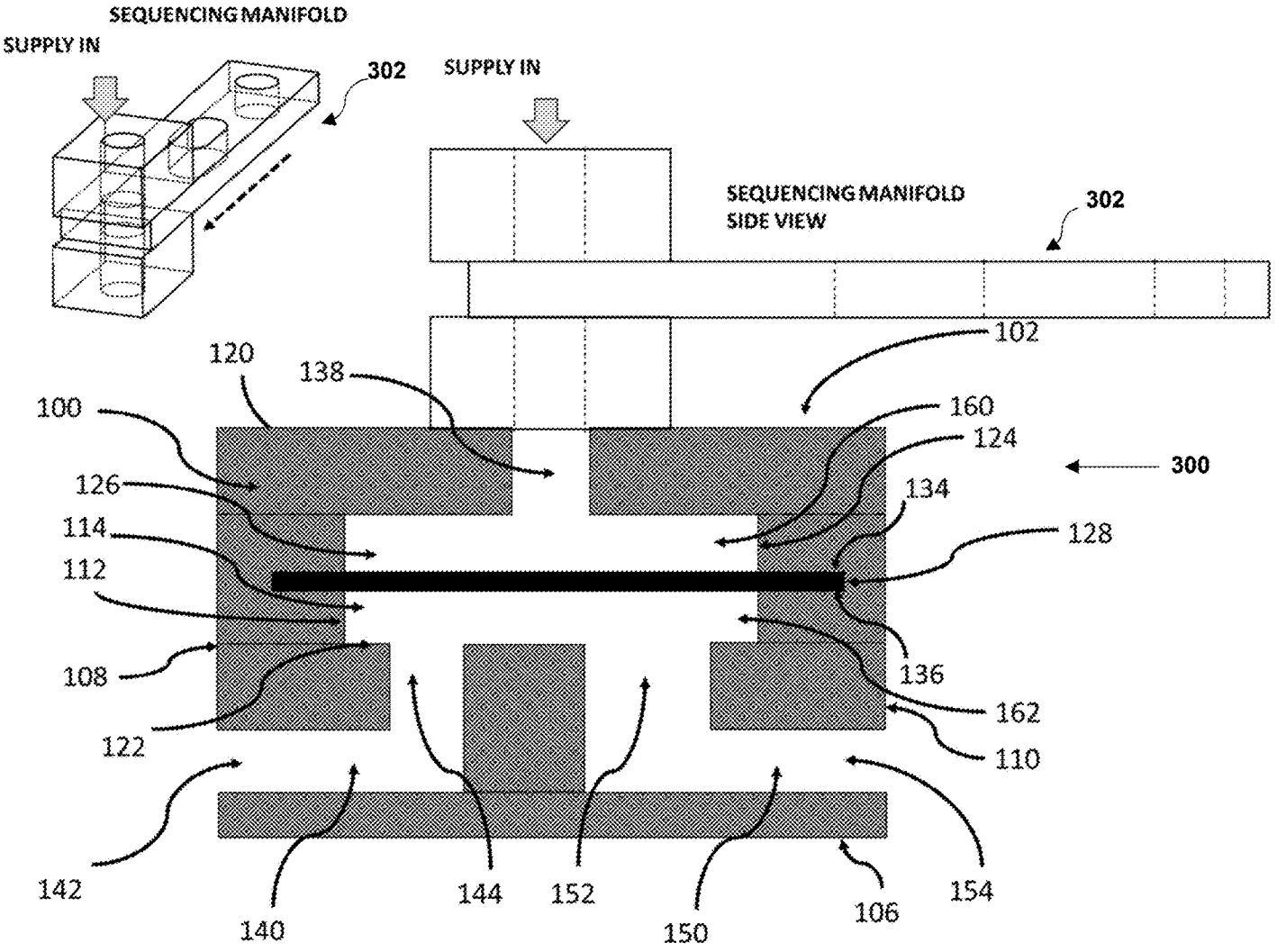
FIG. 1B is a schematic diagram of the embodiment of the microfluidic pump shown in FIG. 1A incorporated in fluid connection with a sequencing manifold according to another embodiment.

Referring now to FIG. 1, a schematic diagram of a side view of one embodiment of the microfluidic pump is shown. As shown in FIG. 1, the pump has an outer pump wall 102, the outer pump wall has a top side 104, a bottom side 106, a first end 108 and a second end 110. The inner wall 112 defines a pumping chamber 114. The pumping chamber 114 has a chamber length 116, a chamber height 118, a chamber top side 120, a chamber bottom side 122, a chamber front side 124*a*, a chamber back side 124*b*, and first and second chamber ends 126*a*, 126*b*. Positioned within the pumping chamber is a flexible drive membrane 128. The flexible drive membrane 128 has a membrane width 130, a membrane thickness 132, a membrane top side 134, and a membrane bottom side 136. The membrane width 130 intersects the chamber height 118 between the chamber top side 120 and chamber bottom side 122 and spans the chamber length 116, forming a pressure chamber 160, and a fluid flow chamber 162 within the pumping chamber 114. Although the flexible drive membrane is shown as intersecting the pumping chamber at approximately mid-point in FIG. 1, a variety of configurations can be used, according to the description, as will be understood by those of skill in the art.

A control port 138 is positioned on the outer pump wall 102 in fluid connection with the pressure chamber 160.

A first fluidic channel 140 having a first inlet port 142, a first outlet port 144, a first channel height 146, and a first port diameter 148 (D1) is positioned in fluid connection with the fluid flow chamber 162 on a side of the pumping chamber 114 opposite the drive membrane 128. The first inlet port 142 is positioned in fluid connection with the outer pump wall 102, and the first outlet port 144 is positioned in fluid connection with the fluid flow chamber 162.

A second fluidic channel 150 having second inlet port 152, a second outlet port 154, a second channel height 156, and a second port diameter 158 (D2) is positioned in fluid connection with the fluid flow chamber 162 on a side of the pumping chamber 114 opposite the drive membrane 128. The second inlet port 152 is positioned in fluid connection with the fluid flow chamber 162 and second outlet port 154 is positioned in fluid connection with the outer pump wall 102.

Figure 2:
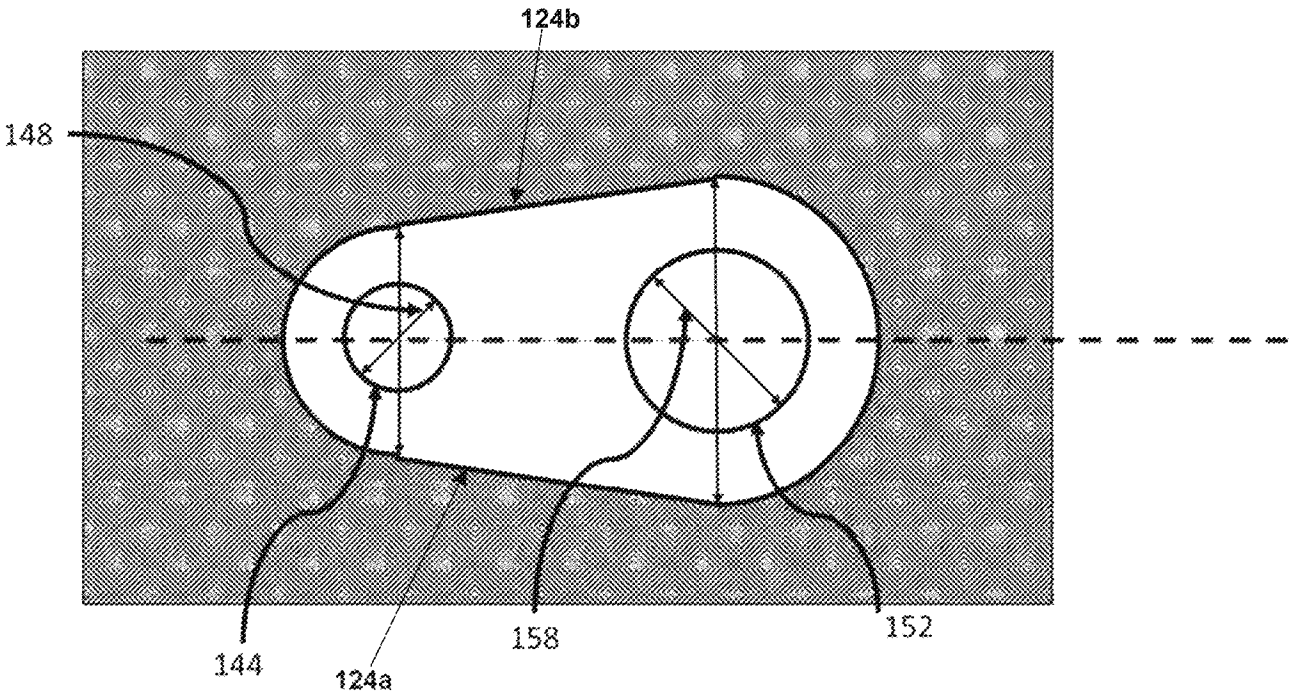
FIG. 2 is a schematic diagram of a top view of a microfluidic pump, illustrating an assymetric configuration of the inlet and outlet valves and pumping chamber, according to another embodiment.
Figure 3:
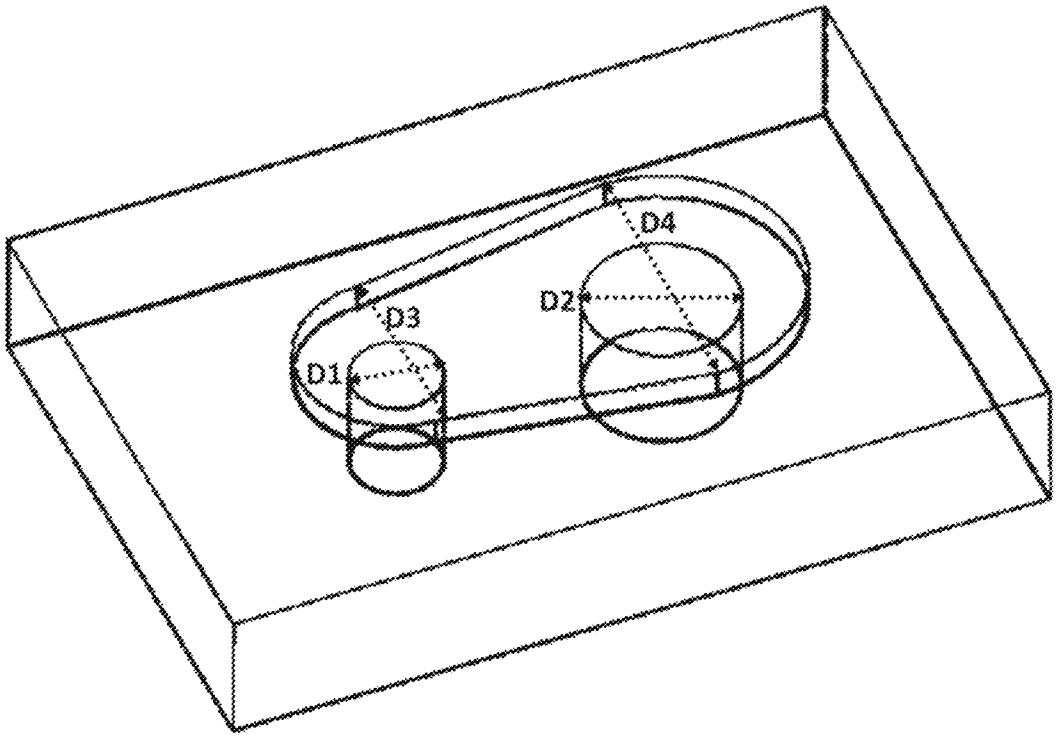
FIG. 3 is a schematic top perspective view of the microfluidic pump, illustrating an assymetric configuration, according to another embodiment.

Referring now to FIG. 1, as well as FIG. 2 and FIG. 3, the first port diameter 148 and the second port diameter 158 are differently sized such that the first port diameter 148 (D1) is smaller than the second port diameter 158 (D2). As shown in FIG. 2 and FIG. 3, the fluid flow chamber 162 has a first chamber diameter 164 (D3), which is the distance between the chamber front side 124*a* and the chamber back side 124*b*, intersecting the first outlet port 144. The fluid flow chamber 160 has a second chamber diameter 166 (D4), which is the distance between the chamber front side 124*a* and the chamber back side 124*b*, intersecting the second inlet port 152. D3 and D4 are differently sized such that the first chamber diameter 164 (D3) is smaller than the second chamber diameter 166 (D4).

A first cross sectional area (A1) is calculated where the radius R1=½ D3 and where $A1=\pi\times R1^2$. A second cross sectional area (A2) is calculated where the radius R2=½ D4, and where $A2=\pi\times R2^2$. In some embodiments, the first cross sectional area A1 is smaller than second cross sectional area A2.

The fluid flow chamber 160 has a flow chamber height 168 (h), measured from the chamber bottom side 122 to the membrane bottom side 136. A first chamber volume V1 is calculated where $V1=\pi\times R1^2\times h$. A second chamber volume V2 is calculated where $V2=\pi\times R2^2\times h$. In some embodiments, the second first chamber volume V2 is smaller than the second chamber volume.

According to the embodiments of this disclosure, net fluid flow from the first inlet port 142 through the fluid flow chamber 162 and to the second outlet port 154 ensues from a variance of positive pressure to negative pressure in the pressure chamber 160. The drive membrane 128 and pumping chamber 114 are configured such that the positive excursion of the drive membrane 128 brings it into contact with the "floor" of the pump chamber, i.e., the bottom side of the pumping chamber 122. Dimensions and location of at least one of the following components is non-symmetrical in at least one direction: pumping chamber dimensions, fluidic ports position/dimensions, control port(s) position.

When positive pressure is applied through the control port 138, the positive pressure flexes the drive membrane 128 such that the drive membrane 128 is moved to a sealed position, where the drive membrane at least partially seals the first fluidic channel 140 at the first outlet port 144 while the second inlet port 152 remains open to fluid flow. When the pressure applied through the control port 138 is released, the drive membrane 128 moves from the sealed position over the first fluidic channel 140 at the first outlet port 144 to an open position. In the open position, there is net fluid flow from the first fluidic channel 140 through the first outlet port 144, through the fluid flow chamber 162, and into the second fluidic channel 154 through the second inlet port 152.

The asymmetric nature of the components ensure both ports are not sealed simultaneously by the drive membrane. During a positive excursion, the drive membrane first makes first contact with the "floor" of the pump chamber 122 at the location of the first outlet port 144 and thereby seals the first fluidic channel 140. As the positive excursion of the drive membrane 128 progresses, the "seal line" of the drive membrane 128 with the "floor" of the pump chamber 122 translate towards the location of the second inlet port 152, thereby driving the fluid content of the fluid flow chamber 162 out the second outlet port 154. During relaxation of the drive membrane 128 back to its neutral position, both ports 144 and 152 unseal and there is flow through the fluid flow chamber 162 through both ports. As in the prior art, net pumping from the first inlet port 142 to the second outlet port 154 is affected by periodically cycling the excursions of the drive membrane.

When the drive membrane 128 of the pump 100 according to this description is subjected to a single positive excursion and is held at its maximum positive excursion, the diaphragm pump 100 mimics the function of a two-way valve in its "closed" state. When the drive membrane 128 of the diaphragm pump 100 of this description is permitted to remain in its neutral position, the diaphragm pump 100 mimics the function of a two-way valve in its "open" state.

According to the disclosure, a pump 100 having the asymmetric shape and ports at asymmetric locations and of asymmetric sizes has been identified. Accordingly, one skilled in the art can fabricate microfluidic diaphragm pumps having multiple combinations of shapes, locations, and sizes that achieve the functions of this description.

An advantage of the embodiments of this description is that having a single moving part, the flexible drive membrane 128, simplifies the fabrication of microfluidic cassettes requiring onboard diaphragm pumps. The fabrication of microfluidic cassettes is further simplified because two distinct fluid control functions can be affected by construction of a single type of structure on the microfluidic cassettes.

Fabrication and Materials

The components of the microfluidic pump according to this description can be fabricated with a variety of materials including but not limited to metals, plastics (thermoplastics, elastomers, thermoset), ceramic, glass, semiconductors (Silicon), photoresists, adhesives. Fabrication techniques that can be used for producing these components include but are not limited to: molding, machining, casting, laser cutting, die cutting, thermal bonding.

Figure 4:
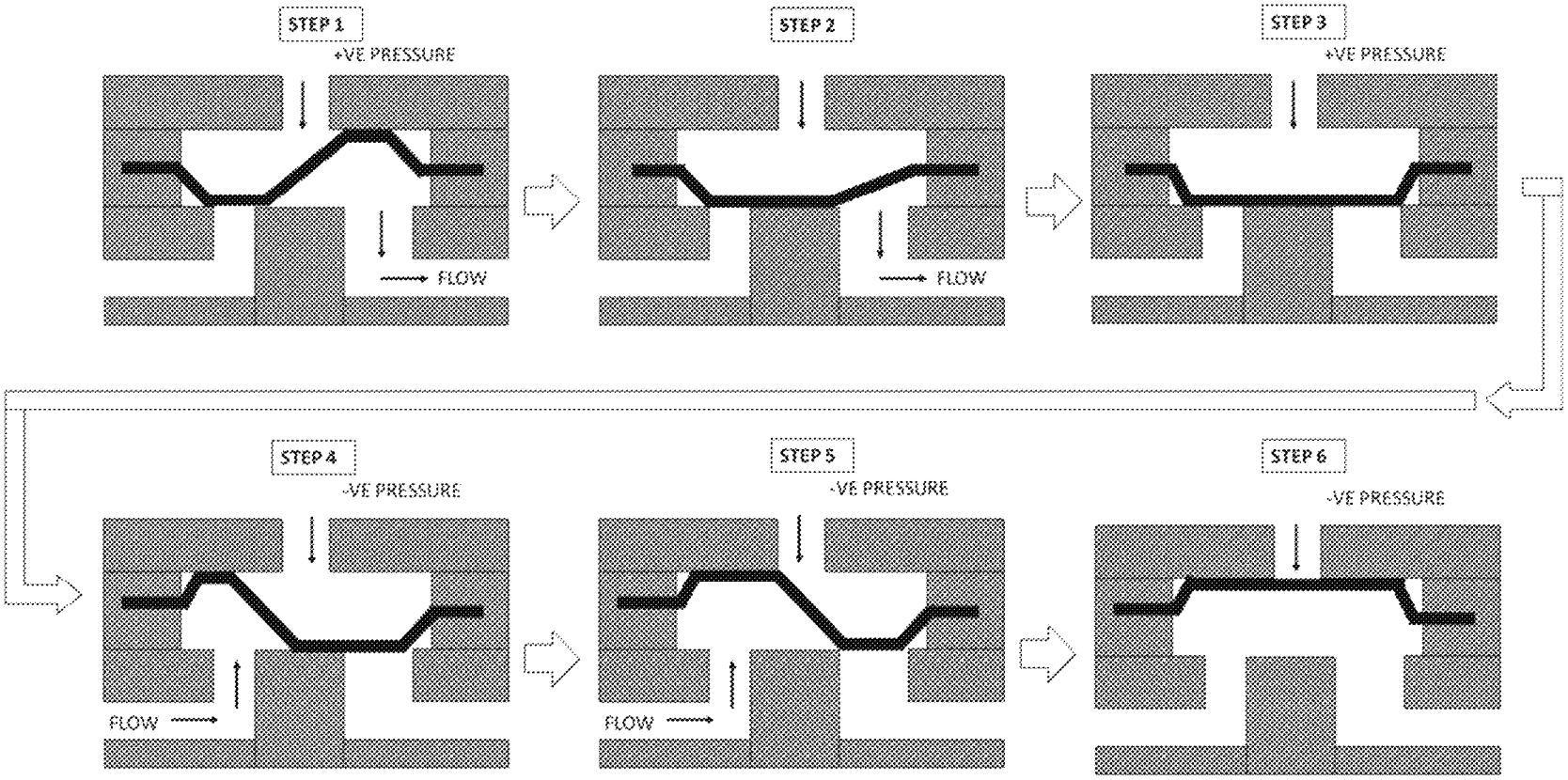
FIG. 4 is a flow chart illustrating the different positions of the valve in response to pressure differentiation in the pressure chamber to effectuate valve closure and fluid in the microfluidic pump, according to another embodiment.
Figure 6:
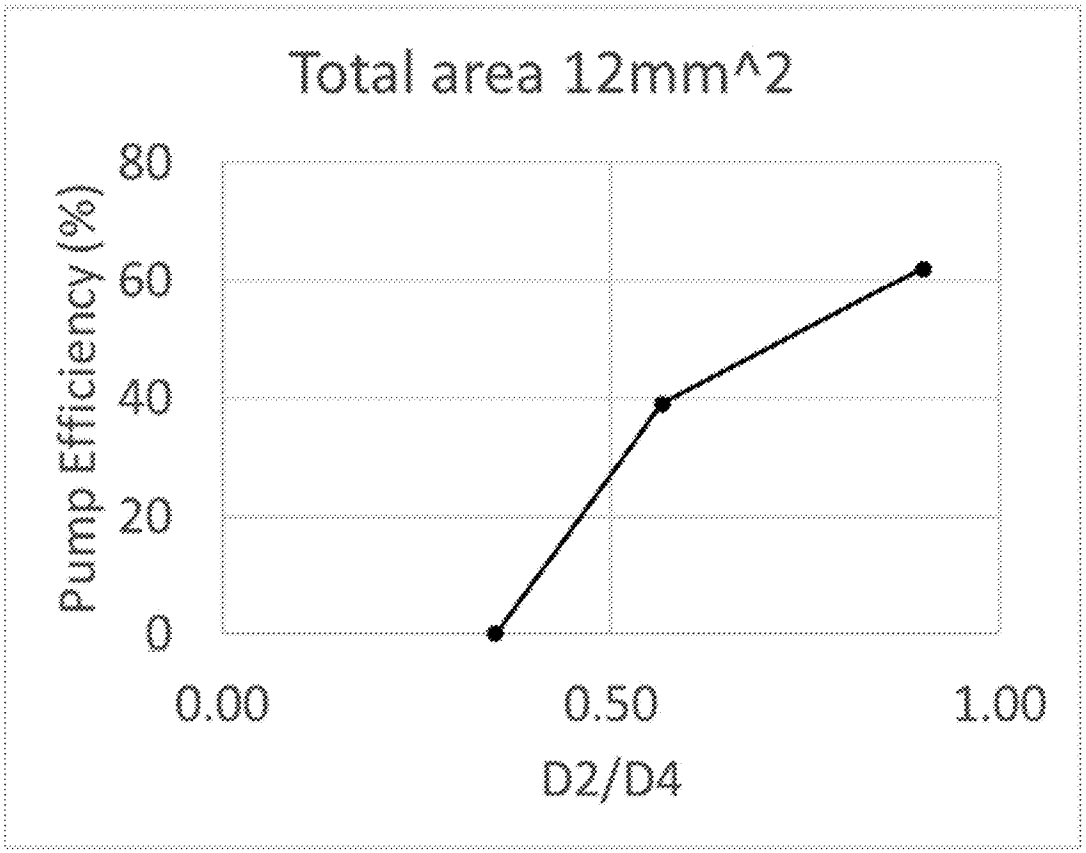
FIG. 6 is a graph showing pumping efficiency for different port diameters.
Figure 7:
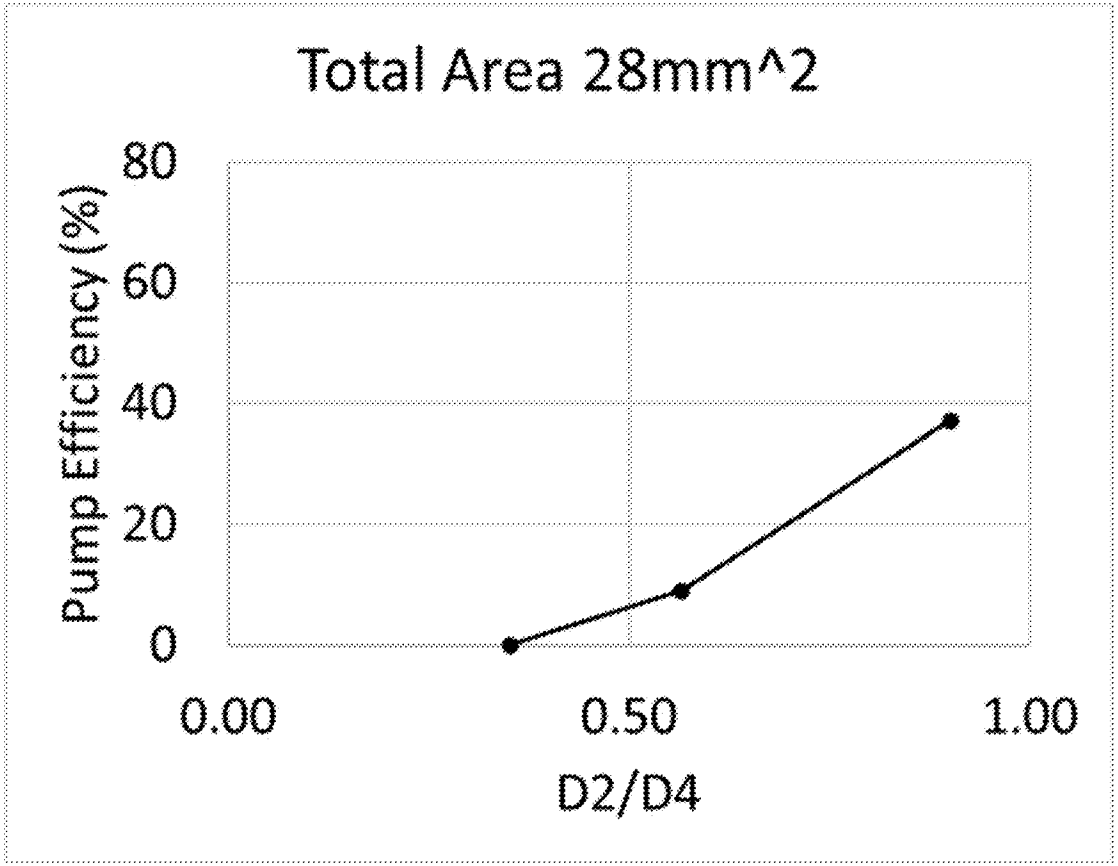
FIG. 7 is a graph showing pumping efficiency for different valve dimensions.
Figure 8:
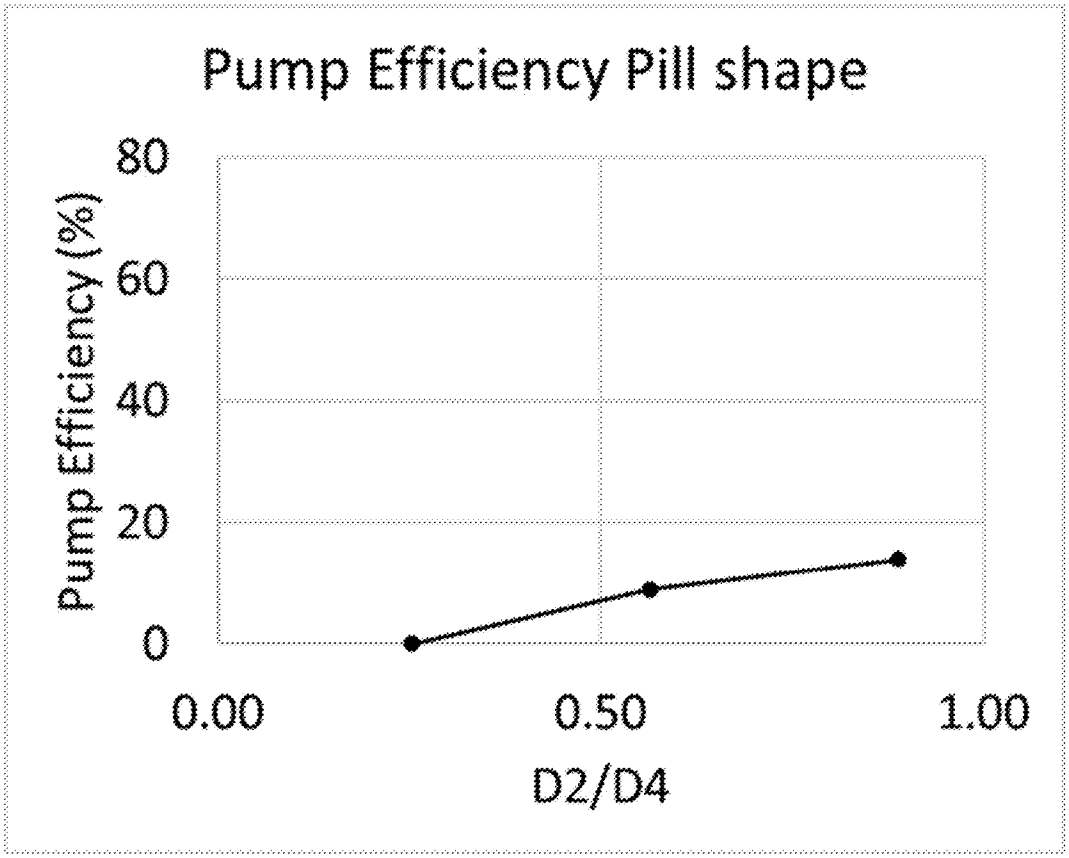
FIG. 8 is a graph showing pumping efficiency for a rounded valve shapes.
Figure 9:
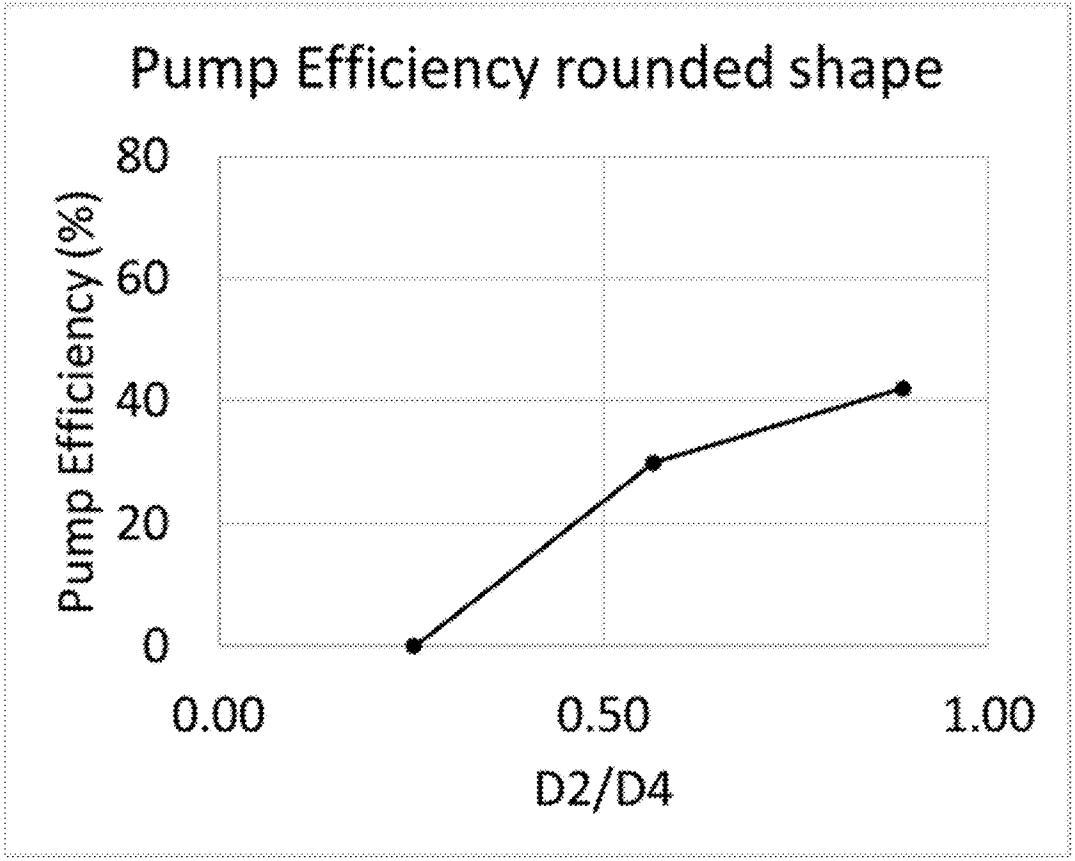
FIG. 9 is a graph showing pumping efficiency for a pill shaped valve shapes.

According to another embodiment, a method of moving fluid with a microfluidic pump is provided. Referring now to FIG. 4, a flow chart with various positions of the membrane 128 in relation to the ports 142 and 144, and fluid flow is shown. According to the method, first, a microfluidic pump according to the description herein is provided. As shown in Step 1, an initial positive pressure is introduced through the control port 138 to at least partially pressurize the pressure chamber 160. The membrane 128 is moved by the pressure in the pressure chamber 160 to a first membrane position (P1) at least partially sealing the second inlet port while the first outlet port remains open to the fluid flow chamber 162. As shown in Step 2, as positive pressure provided through the control port 138 further pressurize the pressure chamber 160, the membrane is moved by the increased pressure in the pressure chamber. As shown in Step 3, further positive pressure through the control port 138 moves the membrane to a second membrane position P2 at least partially sealing both the second inlet port 152 and the first outlet port 144 such that the pump is in a "closed" position. In Step 4 and Step 5, pressure is reduced within the pressure chamber 160 and the membrane is moved by the reduced pressure to a third membrane position P3 at least partially opening the first outlet 144 while the second inlet port 152 remains in at least a partially sealed position. In the P3 position, fluid flows from the first inlet port 142, through the first fluidic channel 140, through the first outlet port 144 and into the fluid flow chamber 162. In Step 6, pressure within the pressure chamber 160 is further reduced and the membrane 128 is moved by the further reduced pressure to a fourth membrane position P4, at least partially opening both the first outlet port 144 and the second inlet port 152. In the P4 position, the pump is in an "open" position, and fluid flows from the first inlet port 142, through the first fluidic channel 140, through the first outlet port 144 into the fluid flow chamber 162, and through the second inlet port 152 and the second fluidic channel 150 to the second outlet port 154.

Moving fluid by the steps described herein by increasing and reducing pressure in the pressure chamber 160 creates a pumping cycle when the steps are repeated in sequence and creates fluid flow through the pump 100.

Referring now to FIGS. 5A-5D, a microfluidic system according to another embodiment is provided. The system 200 shown in FIGS. 5A-5D has a substrate 202, and various embodiments of the microfluidic pump 100*a*-100*d* positioned within the substrate 202. The microfluidic pump 100*a*-100*d* comprises a flexible drive membrane 128 which is pressurized within a pumping chamber to open and close first and second ports within a fluid flow chamber. The diameter of the first port diameter 148 and the second port diameter 158 are differently sized such that the first port diameter 148 is smaller than the second port diameter 158. A first micro-channel 170 is positioned within the substrate 202 and in fluid connection with the first inlet port 142. A second micro-channel 172 is positioned within the substrate 202 and in fluid connection with the second outlet port 152. A third micro-channel 174 is positioned within the substrate 202 and in fluid connection with the control port 138.

In some embodiments, the first inlet port 142 has a first chamber diameter 164 and a second chamber diameter 166, which are differently sized such that the first chamber diameter 164 smaller than the second chamber diameter 166, and the first cross sectional area and first volume are smaller than the second cross sectional area and second volume, as described herein above.

In the microfluidic system described herein, net fluid flows from the first micro channel 170 to the first inlet port 142, through the fluid flow chamber 162, to the second outlet port 152, and to the second micro-channel 172. Net fluid flow ensues from a variance of positive pressure to negative pressure in the pressure chamber 160.

According to one embodiment, the microfluidic system is in fluid connection with a microfluidic device 300 through the third micro-channel 172. The microfluidic pump controls fluid flow to the microfluidic device.

Examples of microfluidic devices include: cell culture and organ on chip devices, flowcells, point of care diagnostics devices, etc.

According to one exemplary embodiment, the microfluidic device 300 is a sequencing manifold 302 and the microfluidic pump 100 controls fluid flow to the sequencing manifold 302. Examples of suitable sequencing manifolds include those described in U.S. Pat. No. 11,035,480, incorporated herein by reference in its entirety.

According to another embodiment, a microfluidic system for supply of a fluid to a fluid processing assembly is provided. The microfluidic system comprises a microfluidic pump 100 as described herein, having a flexible drive membrane 128 which is pressurized within a pumping chamber to open and close first and second ports within a fluid flow chamber. A sequencing manifold is positioned in fluid communication with the microfluidic pump 100.

In some embodiments, the sequencing manifold comprises a movable plate having a plurality of sequence ports and one or more fixed plates having one or more supply ports and one or more control ports in fluid connection with the plurality of sequence ports to supply a fluid to a fluid processing assembly. An example of a suitable sequencing manifold is disclosed in U.S. Pat. No. 11,035,480, incorporated by reference herein in its entirety.

EXAMPLES

The components used for the Examples provided below were produced using laser cutting and lamination with a combination of polymer films (PMMA, PETG, Polyurethane) and pressure sensitive adhesive (Silicone PSA).

Measurement of Pump Efficiency:

The pumping efficiency was calculated by actuating the pump and measuring the distance traveled by the output fluid column in a horizontal tubing with known diameter after a defined number of pumping cycles. This value was used to calculate the actual pumped volume for each cycle. Pumping efficiency was measured by dividing the actual pump volume per stroke by the total volume of the pump. Note that the efficiency is not expected to reach 100% due to limitation in the deformability of the drive membrane material.

What is claimed is:

1. A microfluidic pump comprising:

an outer pump wall, the outer pump wall having a top side, a bottom side, a first end and a second end;

an inner wall defining a pumping chamber, the pumping chamber having a chamber length, a chamber height, a chamber top side, a chamber bottom side, a chamber front side, a chamber back side, and first and second chamber ends;

a flexible drive membrane having a membrane width and a membrane thickness, a membrane top side, and a membrane bottom side, wherein the membrane width intersects the chamber height between the chamber top side and chamber bottom side and spans the chamber width, forming a pressure chamber, and a fluid flow chamber within the pumping chamber;

a control port in fluid connection with the pressure chamber and the outer pump wall;

a first fluidic channel having a first inlet port, a first outlet port, a first channel height, and a first port diameter, the first inlet port being positioned in fluid connection with the outer pump wall, and the first outlet port being positioned in fluid connection with the fluid flow chamber on a side of the pumping chamber opposite the drive membrane;

a second fluidic channel having a second inlet port, a second outlet port, a second channel height, and a second port diameter, the second inlet port being positioned in fluid connection with the fluid flow chamber on a side of the pumping chamber opposite the drive membrane, and the second outlet port being positioned in fluid connection with the outer pump wall, wherein the first port diameter and the second port diameter are differently sized such that the first port diameter is smaller than the second port diameter, and wherein the fluid flow chamber has a first cross sectional area (A1), where the radius R1 is measured from the mid-point of the first outlet port to the inner wall of the pumping chamber, where $A1=\pi\times R1^2$, and the fluid flow chamber has a second cross sectional area (A2) where the radius R2 is measured from the mid-point of the second inlet port to the inner wall of the pumping chamber, and where $A2=\pi\times R2^2$, and where the first cross sectional area A1 is smaller than second cross sectional area A2.

2. The microfluidic pump according to claim 1 wherein the first inlet port has a first chamber diameter and a second chamber diameter, which are differently sized such that the first chamber diameter is smaller than the second chamber diameter.

3. The microfluidic pump according to claim 1 wherein positive pressure applied through the control port flexes the drive membrane to at least partially seal the first fluidic channel at the first outlet port while the second inlet port remains open to fluid flow.

4. The microfluidic pump according to claim 3 wherein relaxation of the pressure applied through the control port relaxes the drive membrane to open the first fluidic channel at the first outlet port and there is net fluid flow from the first fluidic channel through the first outlet port, through the fluid flow chamber, and to the second fluidic channel through the second inlet port.

5. The microfluidic pump according to claim 1 wherein net fluid flow from the first inlet port through the fluid flow chamber and to the second outlet port ensues from a variance of positive pressure to negative pressure in the pressure chamber.

6. A microfluidic system for supply of a fluid to a fluid processing assembly, the microfluidic system comprising:

a microfluidic pump according to claim 1; and a sequencing manifold in fluid communication with the microfluidic pump, the sequencing manifold comprising:

a movable plate and having a plurality of sequence ports; and one or more fixed plates having one or more supply ports and one or more control ports in fluid connection with the plurality of sequence ports to supply a fluid to a fluid processing assembly.

7. A method of moving fluid with a microfluidic pump according to claim 1, the method comprising;

providing a microfluidic pump according to claim 1;

1) introducing an initial positive pressure through the control port to at least partially pressurize the pressure chamber, wherein the membrane is moved by the pressure in the pressure chamber to a first membrane position at least partially sealing the first outlet port while the second inlet port remains in an open position;

2) increasing the positive pressure provided through the control port to further pressurize the pressure chamber, wherein the membrane is moved by the increased pressure in the pressure chamber to a second membrane position at least partially sealing both the first outlet port and the second inlet port;

3) reducing the pressure within the pressure chamber, wherein the membrane is moved by the reduced pressure to a third membrane position at least partially opening the first outlet port while the second inlet port remains in at least a partially sealed position, and wherein fluid flows from the first inlet port, through the first fluidic channel, through the first outlet port and into the fluid flow chamber; and 4) further reducing the pressure within the pressure chamber, wherein the membrane is moved by the further reduced pressure to a fourth membrane position at least partially opening both the first outlet port and the second inlet port, and wherein fluid flows from the first inlet port, through the first fluidic channel, through the first outlet port into the fluid flow chamber, and through the second inlet port and the second fluidic channel to the second outlet port.

8. A method of moving fluid according to claim 7, wherein the steps 1) through 4) of increasing and reducing pressure are repeated in sequence to create a pumping cycle and create fluid flow through the pump.

9. A microfluidic system comprising:

a substrate;

a microfluidic pump positioned within the substrate, the microfluidic pump comprising:

an outer pump wall formed within the substrate, the substrate forming an outer pump wall top side, bottom side, a first end, and second end;

an inner wall defining a pumping chamber, the pumping chamber having a chamber length, a chamber height, a chamber top side, a chamber bottom side, a chamber front side, a chamber back side, and first and second chamber ends;

a flexible drive membrane having a membrane width and a membrane thickness, a membrane top side, and a membrane bottom side, wherein the membrane width intersects the chamber height between the chamber top side and chamber bottom side and spans the chamber width, forming a pressure chamber, and a fluid flow chamber within the pumping chamber;

a control port in fluid connection with the pressure chamber and the outer pump wall;

a first fluidic channel having a first inlet port, a first outlet port, a first channel height, and a first port diameter, the first inlet port being positioned in fluid connection with the outer pump wall, and the first outlet port being positioned in fluid connection with the fluid flow chamber on a side of the pumping chamber opposite the drive membrane;

a second fluidic channel having a second inlet port, a second outlet port, a second channel height, and a second port diameter, the second inlet port being positioned in fluid connection with the fluid flow chamber on a side of the pumping chamber opposite the drive membrane, and the second outlet port being positioned in fluid connection with the outer pump wall, wherein the first port diameter and the second port diameter are differently sized such that the first port diameter is smaller than the second port diameter;

a first micro-channel positioned within the substrate and in fluid connection with the first inlet port;

a second micro-channel positioned within the substrate and in fluid connection with the second outlet port; and a third micro-channel positioned within the substrate and in fluid connection with the control port, wherein the chamber bottom side has a first cross sectional area surrounding and including the dimension of the first inlet port to a mid-point distance between the first and second chamber ends, and a second cross sectional area surrounding and including the dimension of the second inlet port to the mid-point distance between the first and second chamber ends, and wherein the first cross sectional area is smaller than second cross sectional area.

10. The microfluidic system according to claim 9 wherein the first inlet port has a first chamber diameter and a second chamber diameter, which are differently sized such that the first chamber diameter is smaller than the second chamber diameter.

11. The microfluidic system according to claim 9 wherein net fluid flow from the first micro channel to the first inlet port, through the fluid flow chamber, to the second outlet port, and to the second micro-channel ensues from a variance of positive pressure to negative pressure in the pressure chamber.

12. The microfluidic system according to claim 9, further comprising a microfluidic device in fluid connection with the third micro-channel, and wherein the microfluidic pump controls fluid flow to the microfluidic device.

13. The microfluidic system according to claim 12, wherein the microfluidic device is a sequencing manifold and the microfluidic pump controls fluid flow to the sequencing manifold.

* * * * *